US007093549B2

(12) United States Patent
Fujihara

(10) Patent No.: US 7,093,549 B2
(45) Date of Patent: Aug. 22, 2006

(54) WIPER DEVICE FOR SEWING MACHINE

(75) Inventor: Shinya Fujihara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/171,331

(22) Filed: Jul. 1, 2005

(65) Prior Publication Data

US 2006/0005753 A1 Jan. 12, 2006

(30) Foreign Application Priority Data

Jul. 7, 2004 (JP) ..... 2004-200449

(51) Int. Cl.
*D05B 65/00* (2006.01)

(52) U.S. Cl. ..... 112/286; 112/293; 112/300

(58) Field of Classification Search ..... 112/470.01, 112/286, 293, 300, 253
See application file for complete search history.

(56) References Cited

U.S. PATENT DOCUMENTS 6,568,339 B1 * 5/2003 Campbell et al. ..... 112/286

FOREIGN PATENT DOCUMENTS

JP U 6-52782 7/1994
JP A 2003-103080 4/2003

* cited by examiner

*Primary Examiner*—Danny Worrell
(74) *Attorney, Agent, or Firm*—Oliff & Berridge, PLC.

(57) ABSTRACT

A wiper device includes a trimmer to trim an needle thread, a needle bar mounted so as to be vertically moveable and having a sewing needle attached in the lower end, a wiper member to wipe the needle thread extending from an eye of the sewing needle as to pull the needle thread above the upper surface of work cloth after trimming the needle thread, a wiper driving unit to actuate the thread wiping movement of the wiper member and a switch unit to switch the wiper member between an operable state and an inoperable state in conjunction with the position of the needle bar.

8 Claims, 14 Drawing Sheets

WIPER DEVICE FOR SEWING MACHINE

BACKGROUND OF THE INVENTION

1. Field of the Invention

The present invention relates to a wiper device for wiping a trimmed needle thread.

2. Description of the Related Art

Conventionally, sewing machines capable of sewing embroidery are provided with a cloth presser mechanism to drive the cloth presser to press work cloth on performing embroidery sewing, a thread trimmer device to trim a sewing thread on completing the sewing procedure and a thread wiping mechanism to wipe up the trimmed sewing thread with a wiper member have been reduced to practice.

JP-A-2003-103080 discloses a sewing machine of the above-described type, for example. In the vicinity of a bottom surface of a needle plate of a sewing machine bed, a thread trimming device is provided for automatically trimming a needle thread and a bobbin thread. On a head of the sewing machine above the sewing machine bed, a thread wiping device is provided which pulls out the needle thread connected to the sewing needle by lifting the needle thread onto the needle plate.

To describe the operation of the thread wiping device, when the wiper is driven by a wiper drive mechanism with a needle bar and the cloth presser in lifted position, the needle thread trimmed by the thread trimming device is hooked on a wiper hook to be pulled out of the work cloth and above the needle plate. Then the needle thread is further held by a needle thread retainer.

Also a wiper device of a sewing machine disclosed in JP-U-6-52782 includes a wiper body rotatably supported by a sewing machine frame, a presser to press the work piece to be sewn, a vertically moving unit to be vertically moved with the presser, and a connecting link having one end contacting an upper end of the vertically moving unit, and the other end connected to the wiper body. In this wiper device, the wiping of the sewing thread is actuated by lifting the presser of the sewing machine, which in turn lifts the vertically moving unit contacting the presser. Then, the lifting of the vertically moving unit moves a lower end of the wiper body towards the sewing needle via the connection link to wipe up the sewing thread.

A thread wiping device disclosed in JP-A-2003-103080 is provided in a main body of the sewing machine, and the drive of a wiper is controlled by a wiper drive mechanism in synchronization with the thread trimming movement, thereby leading to increased complexity, size and cost.

In the wiper device in the sewing machine disclosed in JP-U-6-52782, the wiper body moves in conjunction with the vertical movement of the presser and the wiper body is lifted by the lifting of the presser. Therefore, for example, in case the presser is lifted without trimming the needle thread, the needle thread is forcibly pulled by the wiper body, which leads to a problem of deformation of the wiper body and sewing needle.

SUMMARY OF THE INVENTION

It is an object of the present invention to solve the above problem and the purpose of the invention is to provide a wiping device of a sewing machine capable of actuating a wiper member with a simple configuration and also capable of preventing the deformation of the wiper member and sewing needle.

An aspect of the present invention is to provide a wiper device for a sewing machine comprising a thread trimmer to trim a needle thread, a needle bar provided vertically moveably having a sewing needle attached on a lower end, a wiper member to wipe the needle thread so as to pull out the needle thread extending from an eye of a sewing needle after trimming the needle thread by the thread trimmer to an upper surface of work cloth, a wiper driving unit to actuate a thread wiping operation of the wiper member, and a switch unit to switch the wiper member between an operable state and an inoperable state in conjunction with a position of the needle bar.

In the above configuration, the needle thread is pulled out to the upper surface of the work cloth by actuating the wiper member by the wiper driving unit after trimming the thread crossing a plurality of embroidery areas or after trimming the needle thread after changing the color of the sewing thread or completing the sewing sequence. Also, the wiper member can be switched between the operable and inoperable state by the switching unit.

Another aspect of the invention is to provide a wiper device for a sewing machine comprising a thread trimmer to trim a needle thread, a needle bar provided vertically moveably having a sewing needle attached on a lower end, a presser bar which is provided vertically moveably and to which a support member having a presser foot in the lower end is detachably attached, a wiper member to wipe the needle thread so as to pull out the needle thread extending from an eye of the sewing needle after trimming the needle thread by the thread trimmer to an upper surface of work cloth, a wiper driving unit to actuate a thread wiping operation of the wiper member, and a switch unit to switch the wiper member between an operable state and an inoperable state in conjunction with a position of the needle bar.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Figure 1:
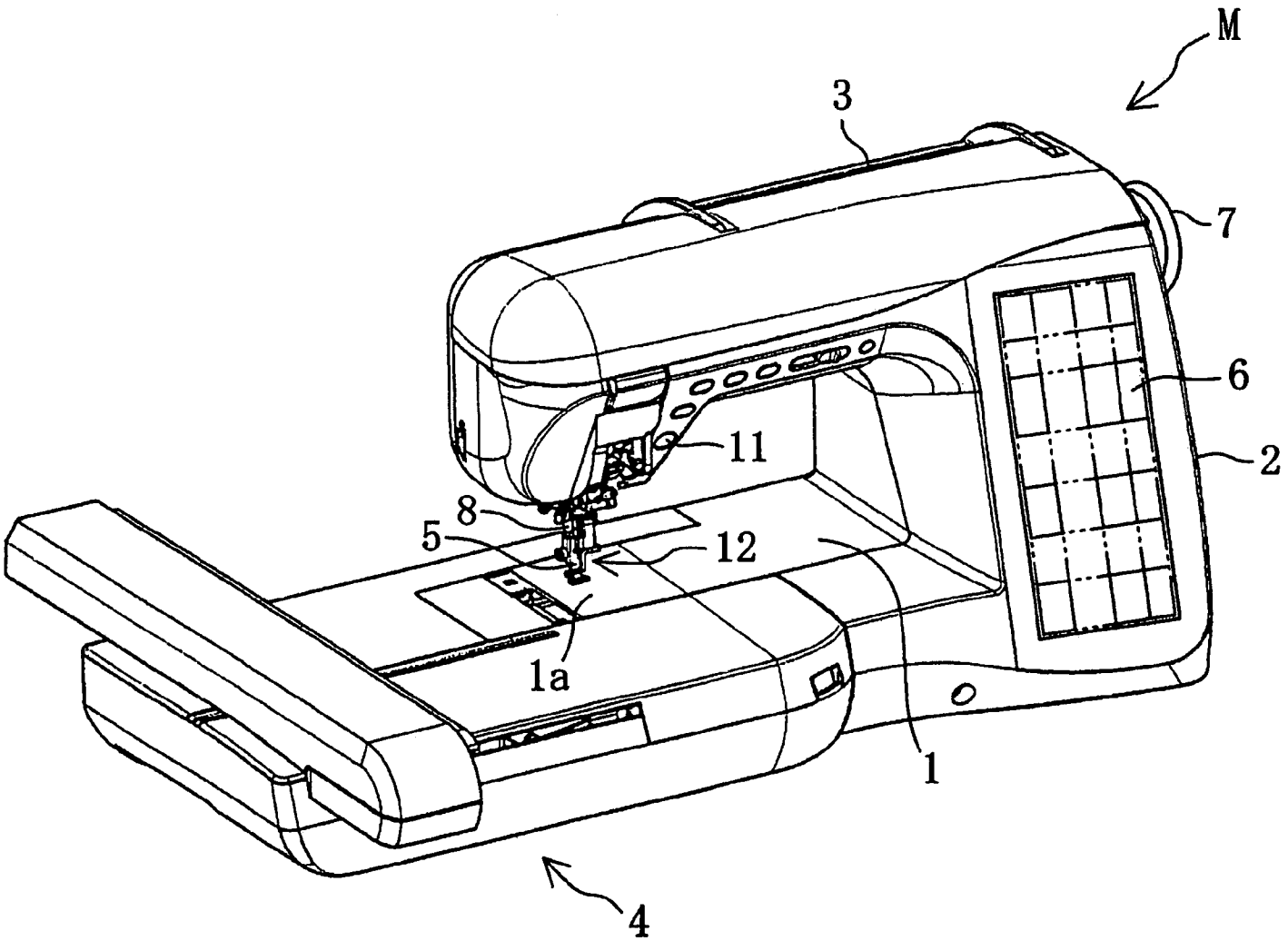
FIG. 1 shows a perspective view of an embroidery sewing machine in accordance with an embodiment of the present invention.
Figure 2:
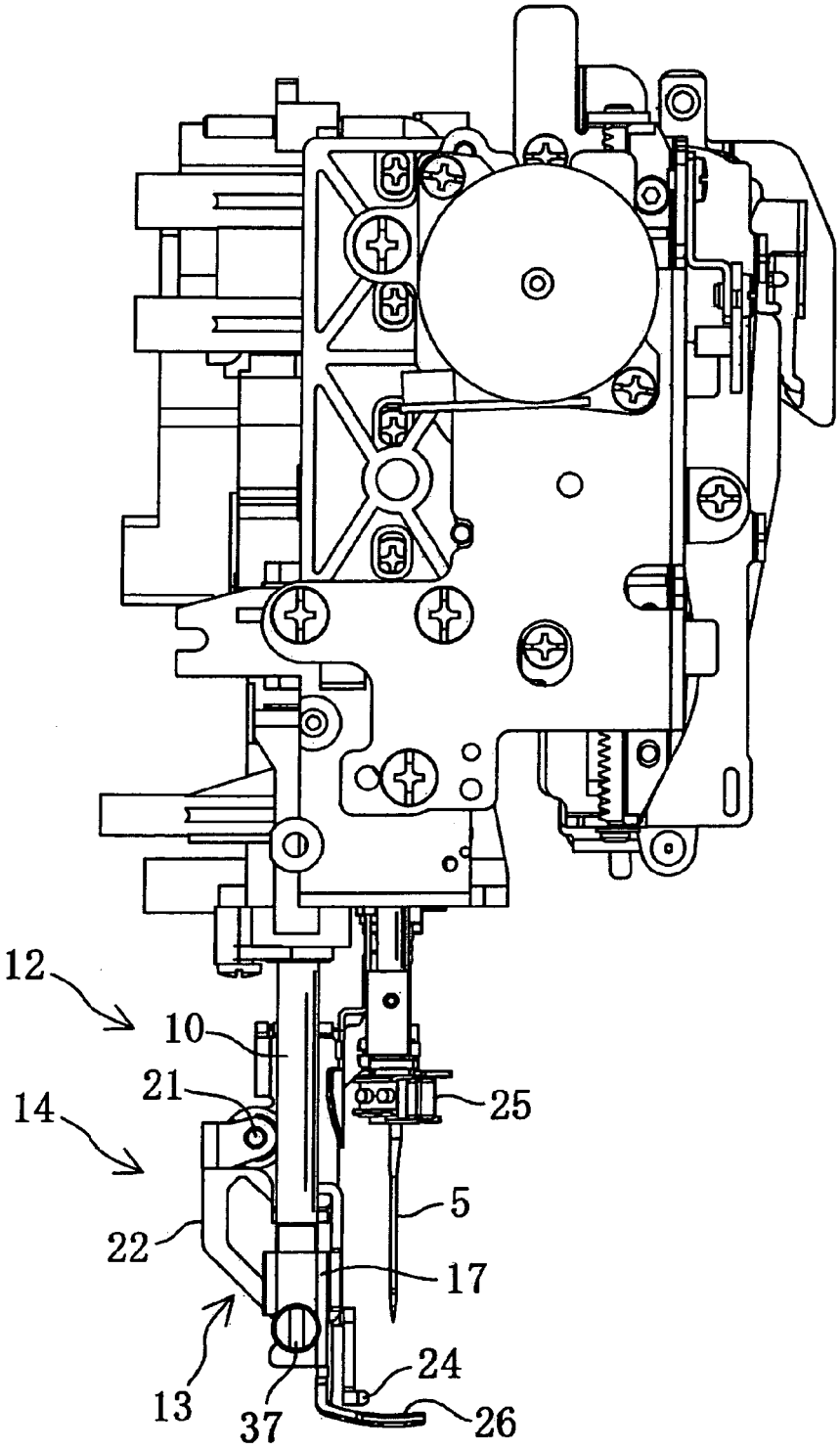
FIG. 2 shows a left side view of a wiper device when a needle bar is swung to the left.
Figure 3:
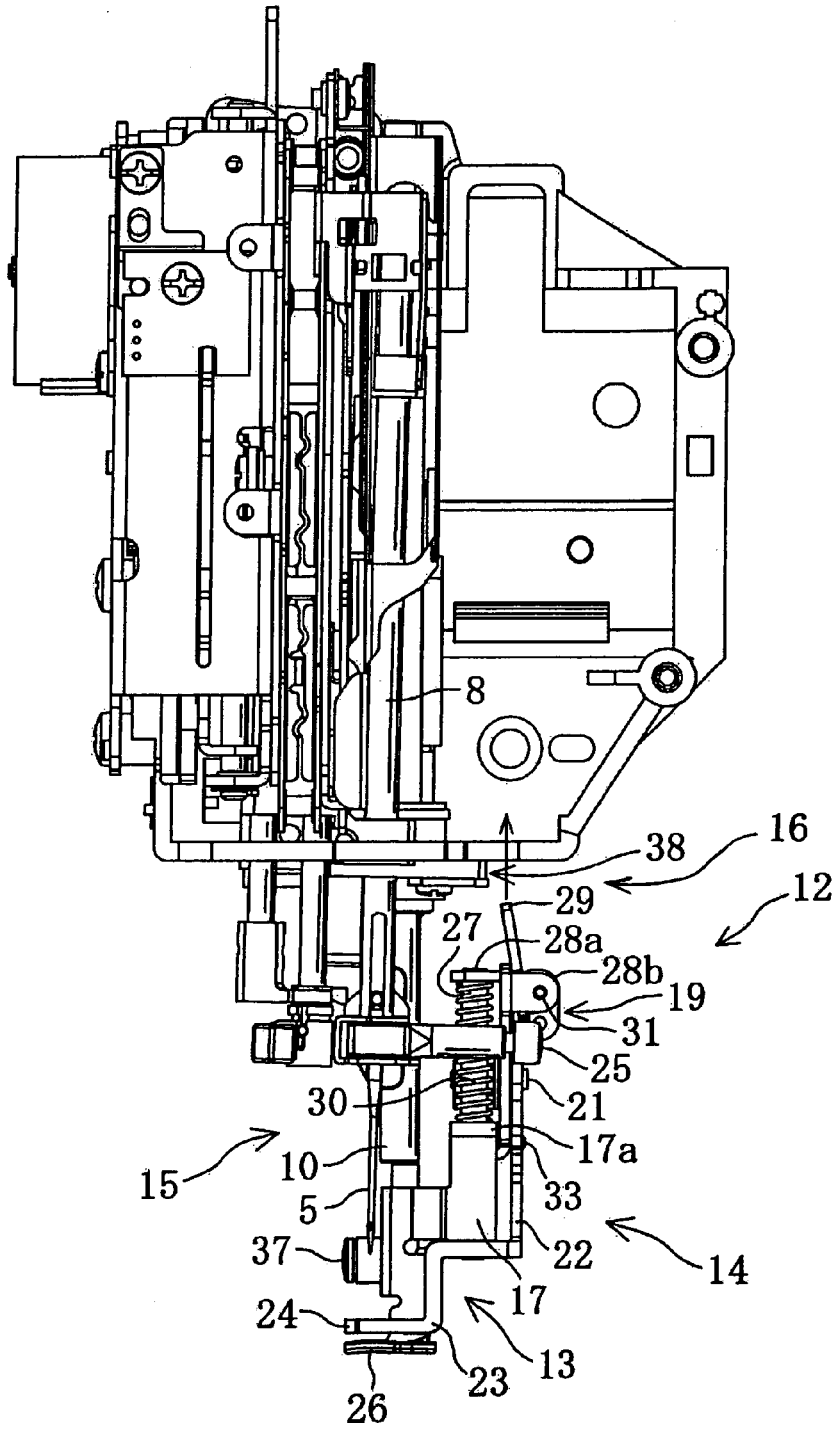
FIG. 3 shows a front view of the wiper device when the needle bar is swung to the left.

An embodiment of the present invention is described hereunder with reference to the drawings. A sewing machine M capable of embroidery sewing as shown in FIG. 1 is explained herein under. This sewing machine M is a household electronically-controlled sewing machine as well known in the art and this sewing machine M is provided with a bed 1, a pillar 2 which stands on a right end of the bed 1, and an arm 3 extending over the bed 1 leftward from an upper end of the pillar 2. On a left end of the bed 1 is detachably attached an embroidery frame drive mechanism 4 for sewing embroidery using an embroidery frame (not shown). The embroidery frame drive mechanism 4 drives the embroidery frame to the X direction (lateral direction) and the Y direction (longitudinal direction) independently.

Figure 14:
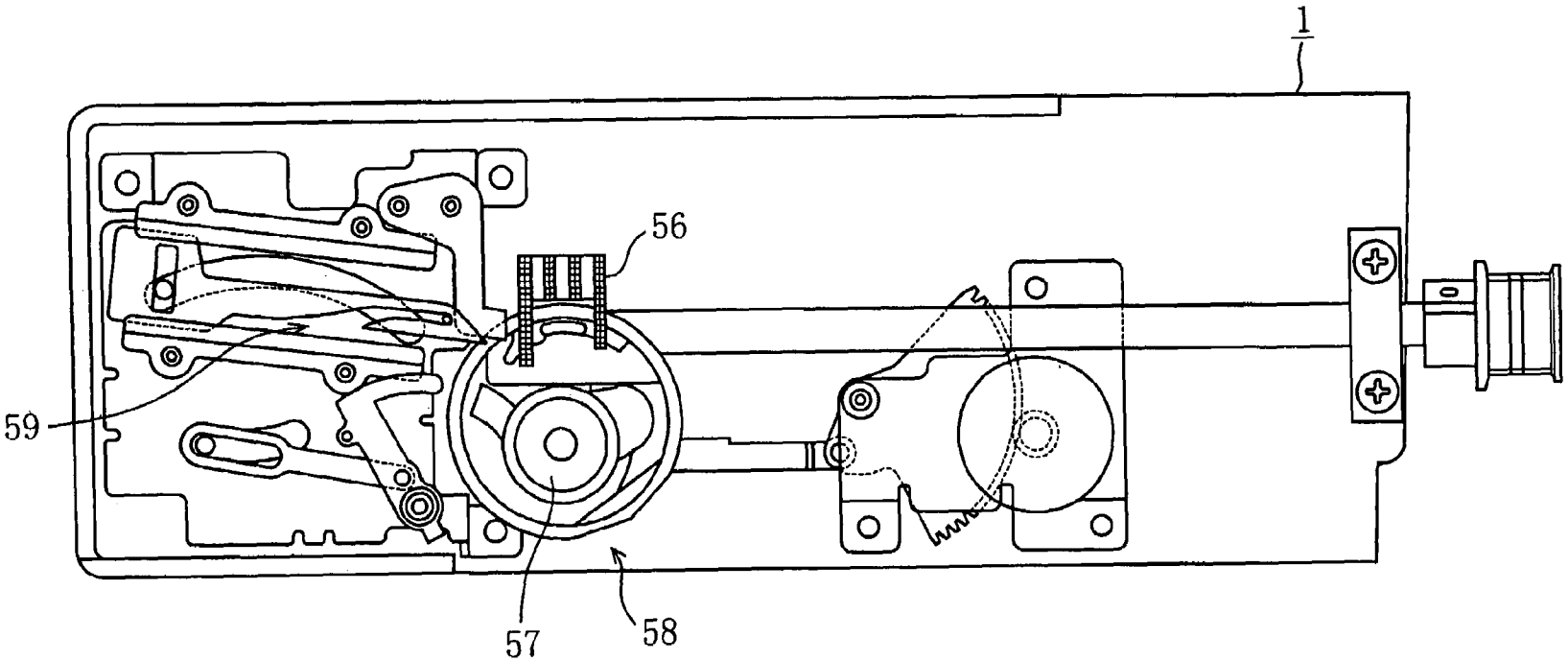
FIG. 14 shows the arrangement under the bed.

Below a needle plate 1*a* of the bed 1 are provided a feed dog vertically moving mechanism (only the feed dog 56 is shown); a feed dog laterally moving mechanism (only the feed dog 56 is shown); a shuttle mechanism to detachably attach a bobbin on which a bobbin thread is wound; and a thread trimmer to trim the needle thread and bobbin thread, as shown in FIG. 14. Also, in the front surface of the pillar 2 is provided a liquid crystal display 6.

In the arm 3 are provided a laterally extending sewing machine main shaft (not shown) rotationally driven by a sewing machine motor 68 (refer to FIG. 15); a hand pulley 7 capable of rotating the sewing machine main axis with manual operation; and a needle bar drive mechanism (not shown) to vertically move a needle bar 8 with a sewing needle attached in the lower end. In the arm 3 are also provided a needle swinging mechanism 9 (refer to FIG. 11) to swing the needle bar 8 in a lateral direction perpendicular to the cloth feeding direction; a thread take-up lever drive mechanism (not shown); and a vertically moving mechanism (not shown) including a presser bar driving motor (stepping motor) 72 (refer to FIG. 15) fixed to the sewing machine frame and lifting a presser bar 10 between an elevated position and a lowered position, the presser bar 10 being vertically moveably supported by the sewing machine frame.

In the front side of the arm 3 is provided a sewing start/stop switch 11 to operate the starting and stopping of the sewing process. A wiper device 12 is provided on the head of the arm 3 to wipe off the needle thread so as to pull out the needle thread extending from the eye of the sewing needle 5 after trimming the needle thread by the thread trimmer 59 to the upper surface of the work cloth. The wiper device 12 will be discussed in detail hereinafter.

Figure 15:
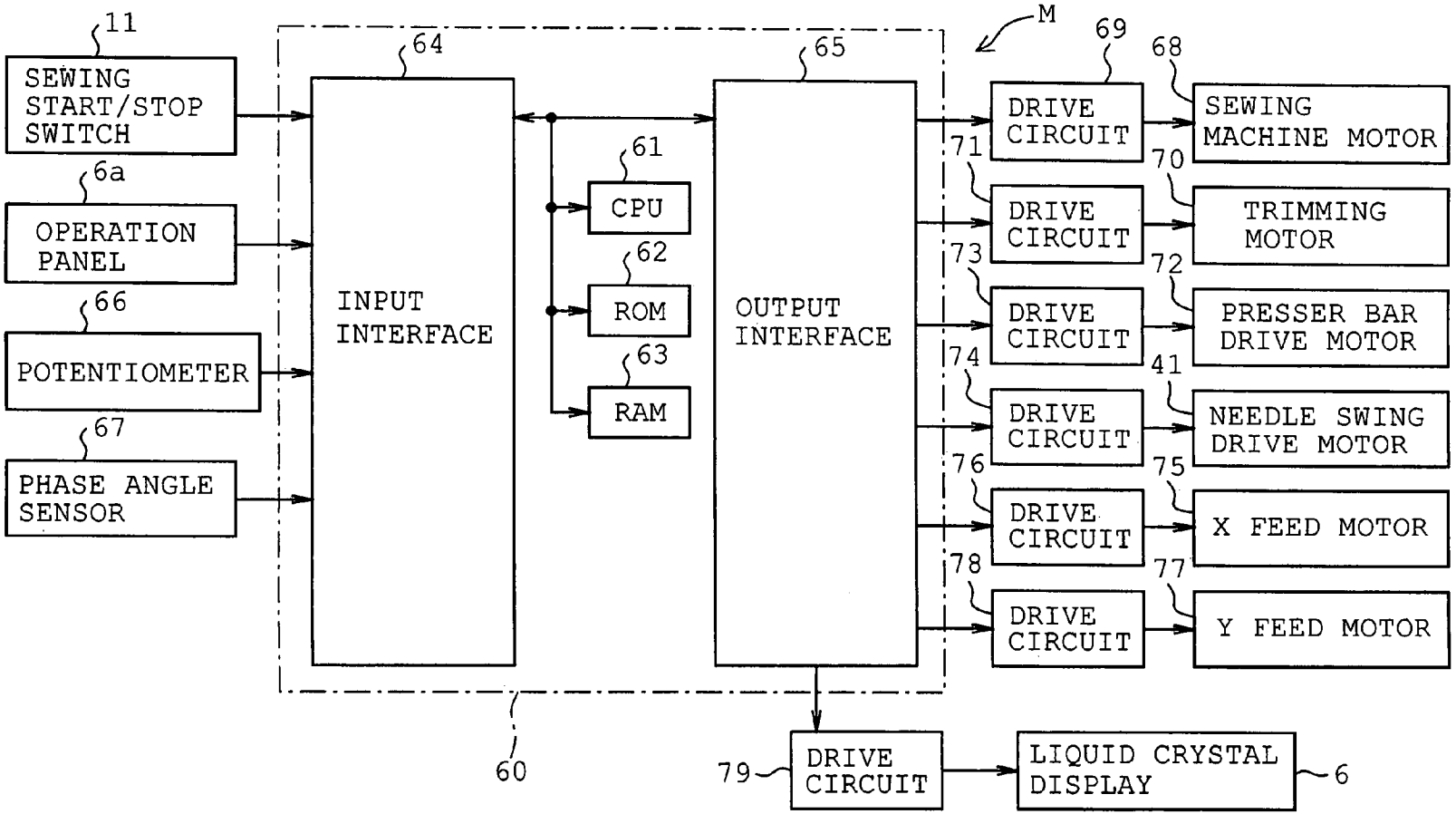
FIG. 15 is a block figure of the control system of the sewing machine.

Next, the control system of the sewing machine M will be described with reference to FIG. 15. The control device 60 of sewing machine M is provided with a microcomputer including a CPU 61, a ROM 62, and a RAM 63; an input interface 64; and an output interface 65. In the input interface 64, a sewing start/stop switch 11, an operation panel 6*a* provided as a touch pad on the liquid crystal display, a potentiometer 66 and a phase angle sensor 67 are electrically connected.

A circular encoding disk is secured on a main shaft of the sewing machine. The encoding disk is formed with a plurality of small slits radially arranged at intervals of predetermined small angles is fixed and the phase angle sensor 67 made of a photo-interrupter outputs encoding signals for each reception of light passing through the slits, in response to the rotation of the sewing machine main shaft. The control device 60 counts the pulse encoder signals to detect a phase angle of the sewing machine main shaft. However, it is assumed that the phase angle of the sewing machine main shaft is at 0 degrees when the needle bar 8 is in the highest position. The count value is cleared when the phase angle is at 0 degrees.

To the output interface 65 are electrically connected a drive circuit 69 for a sewing machine motor 68, a drive circuit 71 for a trimming motor 70, and a drive circuit 73 for presser bar drive motor 72. To the output interface 65 are also connected a drive circuit 74 for a needle swing drive motor (stepping motor) 41 to drive the needle swinging mechanism 9 and a drive circuit 76 for an X feed motor 75 provided in the embroidery frame drive mechanism 4 and drive circuit 78 for a Y feed motor 77 and a drive circuit 79 for a liquid crystal display 6 is electrically connected.

In the ROM 62 are stored a utility pattern sewing data for a plurality of utility embroidery such as zigzag seams, a plurality types of embroidery data for embroidery sewing, drive control programs of various types to control the sewing machine M and a control program etc. for embroidery sewing control. In the RAM 63 are provided various types of memory, pointer and counter etc. to store the calculated results of the calculation processed in the CPU 61, based on necessity.

Next, the wiper device 12 will be described. As shown in FIGS. 2 to 9, the wiper device 12 is provided with a wiper mechanism 14 including a wiper member 13 to wipe the thread, a wiper driving unit 15 to generate the thread wiping movement of the wiper member 13 by driving the wiper mechanism 14 and a switch means 16 to switch the wiper member 13 between an operable state and an inoperable state in conjunction with position of the needle bar B.

Next the wiper mechanism 14 and wiper member 13 are described in detail with reference to FIGS. 2 to 5. The wiper mechanism 14 is configured by including a wiper member 13, a support member 17, a support axis 27, a drive power input member and a link mechanism 20.

The support member 17 is attached to the lower end of the presser bar 10 with a fastening screw 37 and on the lower end of the support member 17, a presser foot 26 is integrally formed. On the support member 17, a vertically paired support 17*a* is provided, in which a vertical support axis 27 fixed by being inserted therethrough is supported to extend in the upper direction.

A drive power input member 19 is provided on the support member 17 via the support axis 27. The drive power input member 19 is provided with a main body member 28 supported by the support shaft 27 and a contacting portion 29 pivotally attached in a laterally swingable manner to the main body member 28.

A pair of upper and lower guided portions 28*a* are formed on the main body member 28. The lower guided portion 28*a* is arranged in between a pair of upper and lower supports 17*a* and fitted with the support shaft 27 so as to be vertically slidable. The upper guided portion 28*a* is arranged above the upper support 17*a* and fitted with the support shaft 27 so as to be vertically slidable. As a result, the main body member 28 is supported on the support shaft 27 so as to be vertically slidable. Further, an elastic member 30 configured by a compressed coil spring is attached to the support shaft 27 in between the support 27*a* on the upper end and the guided portion 28*a* in the upper end. The drive power input member 19 is biased upward by the elastic member 30.

A pair of front and rear support pieces 28*b* are on the upper end of the main body member 28 so as to protrude rightward. A horizontal support shaft 31 is fixed between the support pieces 28*b* so as to be directed in a back-and-forth direction as viewed at the front. A contacting portion 29 is swingably and immovably supported on the horizontal support axis 31. Also, the contacting portion 29 is biased counter-clockwise when viewed from the front by the elasticity of the twisted coil spring 32 attached on the exterior of horizontal support axis 31. Furthermore, the contacting portion 29 can swing approximately 30 degrees clockwise from the locked state.

Next, the wiper member 13 will be described. A horizontal pivotal support axis 21 is fixed in parallel to the needle swing of the needle bar 8 on the main body member 28 of the drive power input member 19 and a wiper member 13 is supported so as to be swingable and immovable in the axial direction. The wiper member 13 is arranged to be installed to the support member 17 (having a presser foot 26) via the drive power input member 19. The wiper member 13 is provided with a circumventing arm 22 and thread wiper 23 integrally formed with the lower end of the circumventing arm 22. The thread wiper 23 is formed in a crank when viewed from the front. On the end point of the thread wiper 23, a regulator 24 is provided and it keeps the needle thread 10 which was wiped up from slipping off the thread wiper 13. The circumventing arm 22 is formed so as not to interfere with a needle fastening member 25 affixing the sewing needle 5 to the needle bar 8 on carrying out the thread wipe by the upward swing of the wiper member 13.

Figure 4:
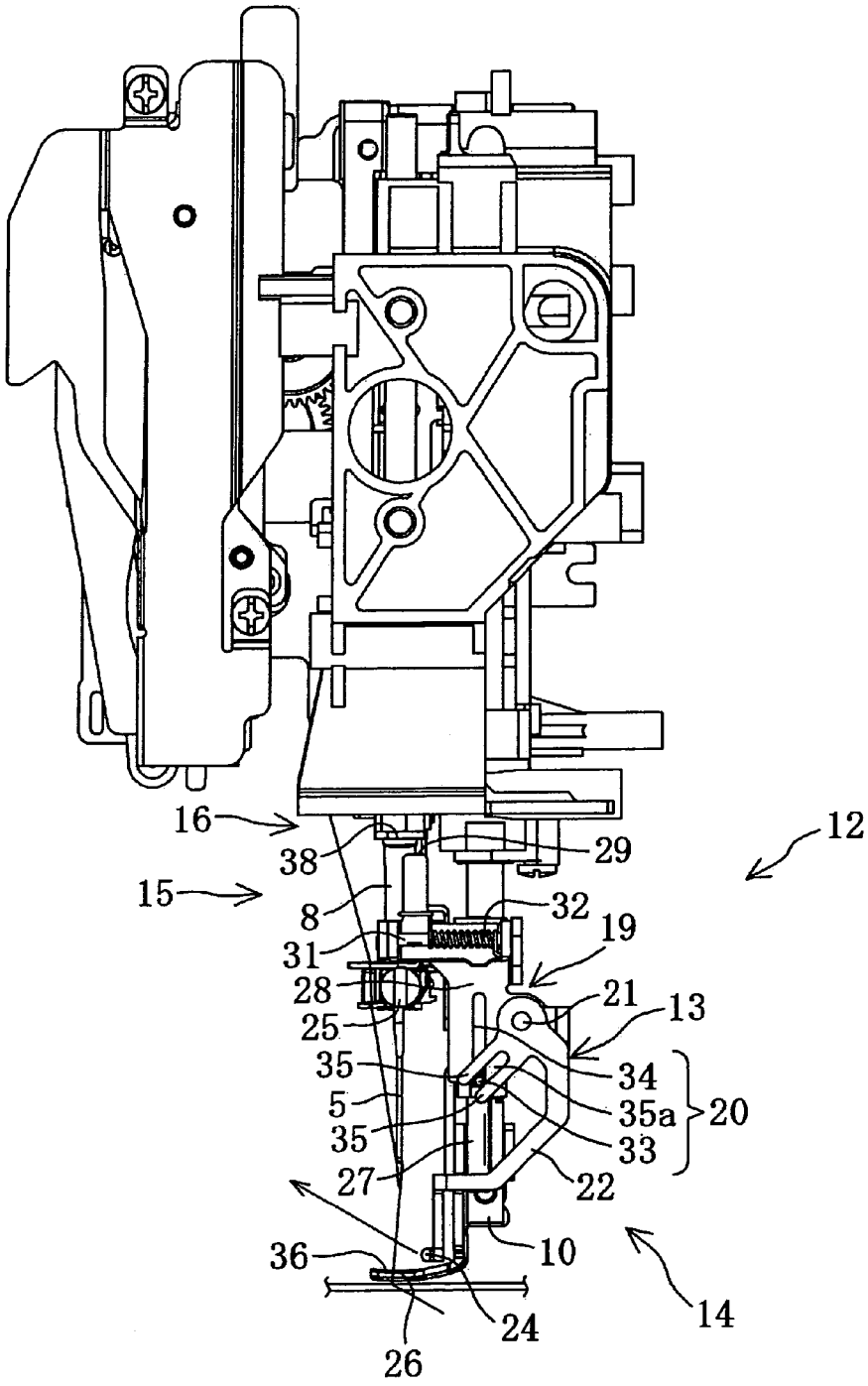
FIG. 4 shows a right side view of the wiper device when the needle bar is swung to the left.
Figure 5:
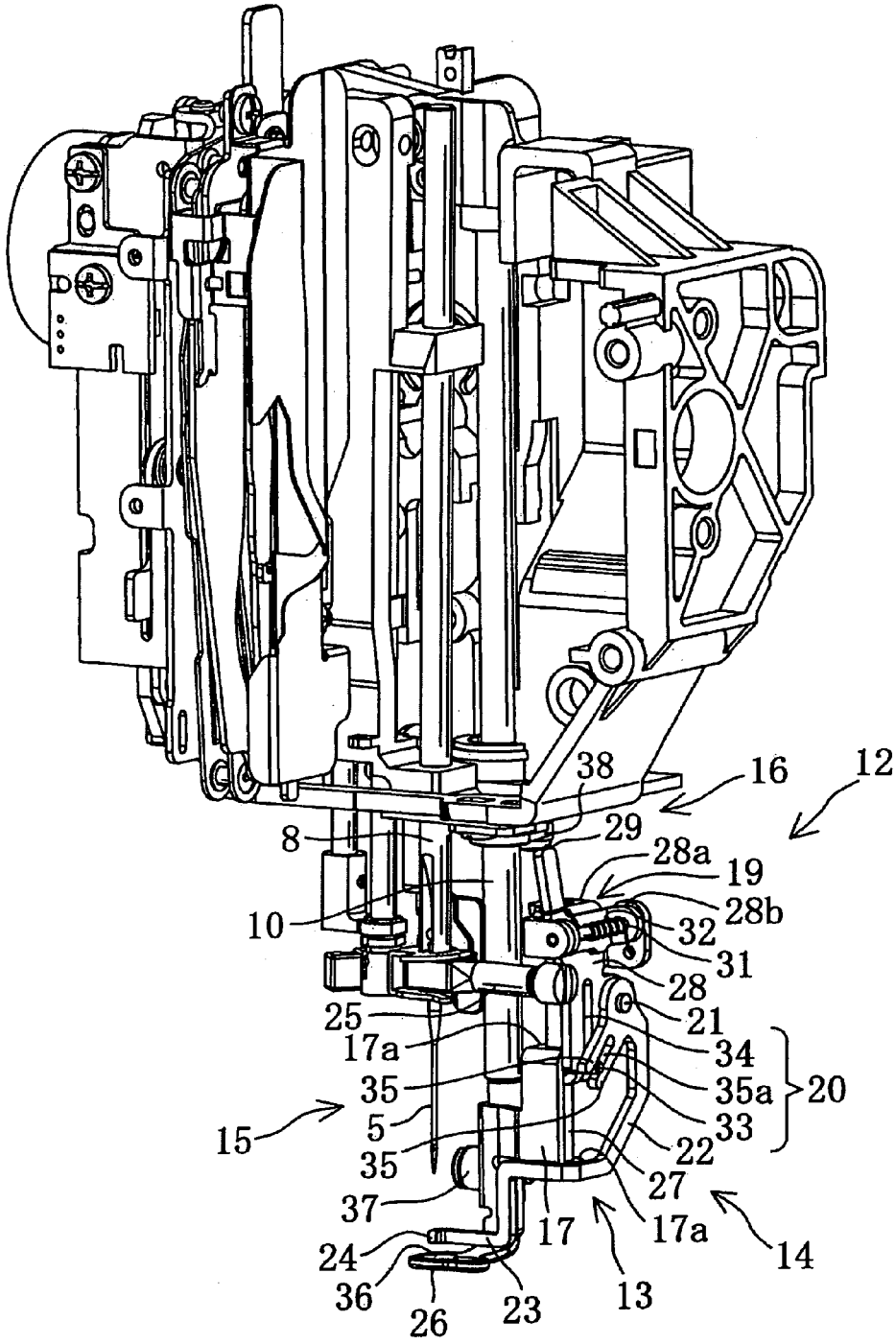
FIG. 5 shows a perspective view of the wiper mechanism when the wiper member is in an inoperable state.
Figure 6:
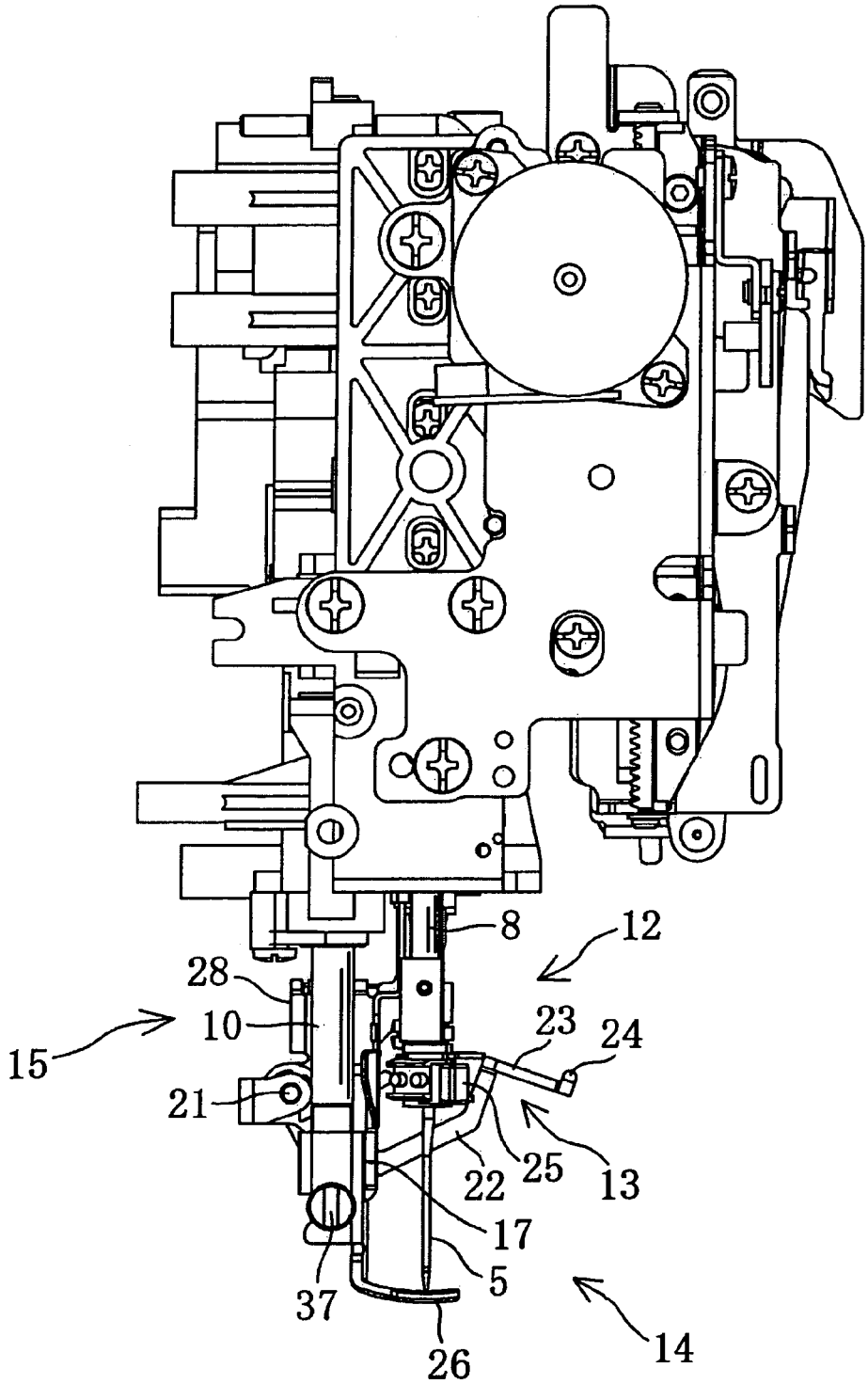
FIG. 6 shows a left side view of the wiper device when the needle bar is swung to the right.
Figure 7:
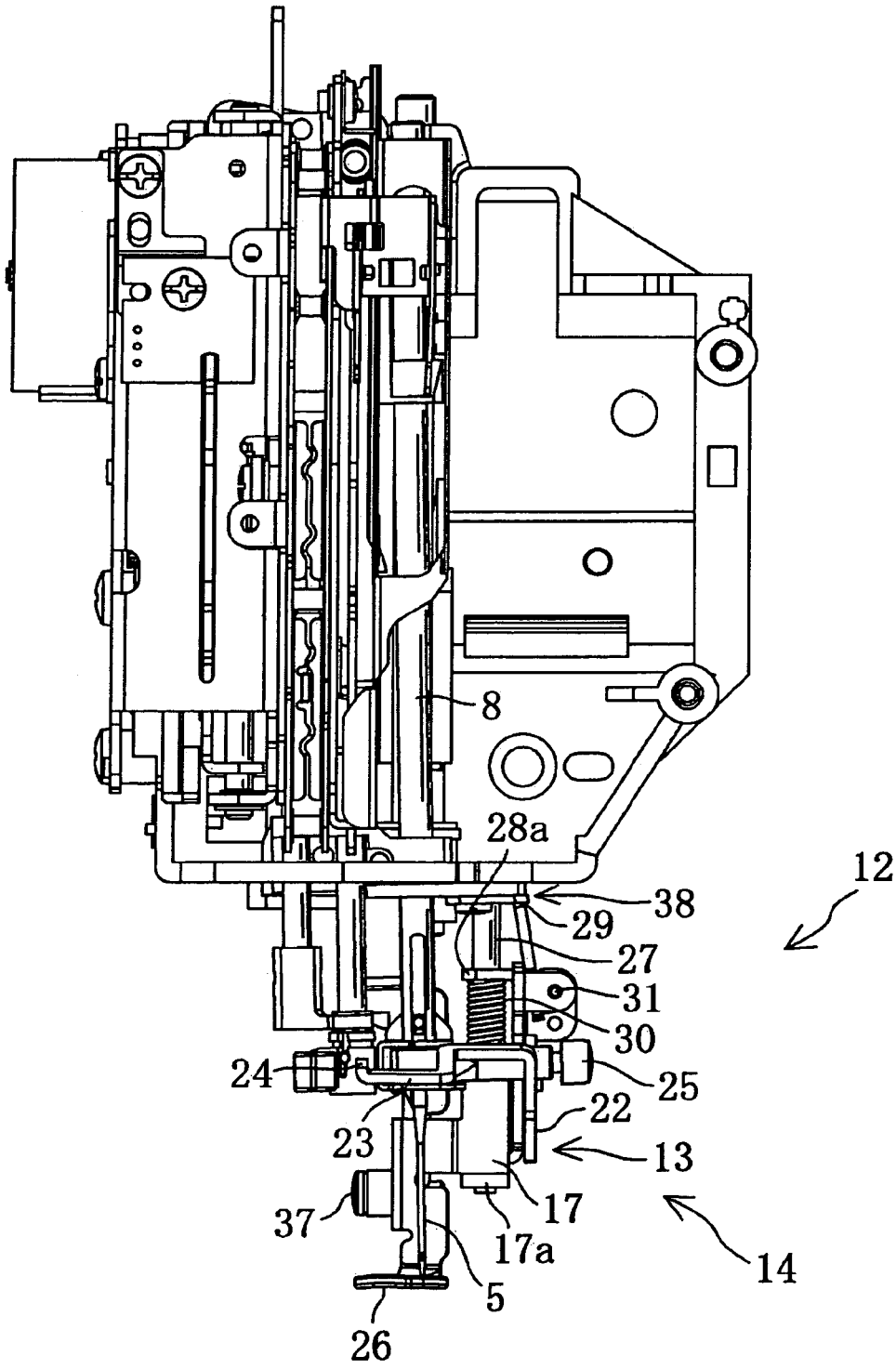
FIG. 7 shows a front view of the wiper device when the needle bar is swung to the right.
Figure 8:
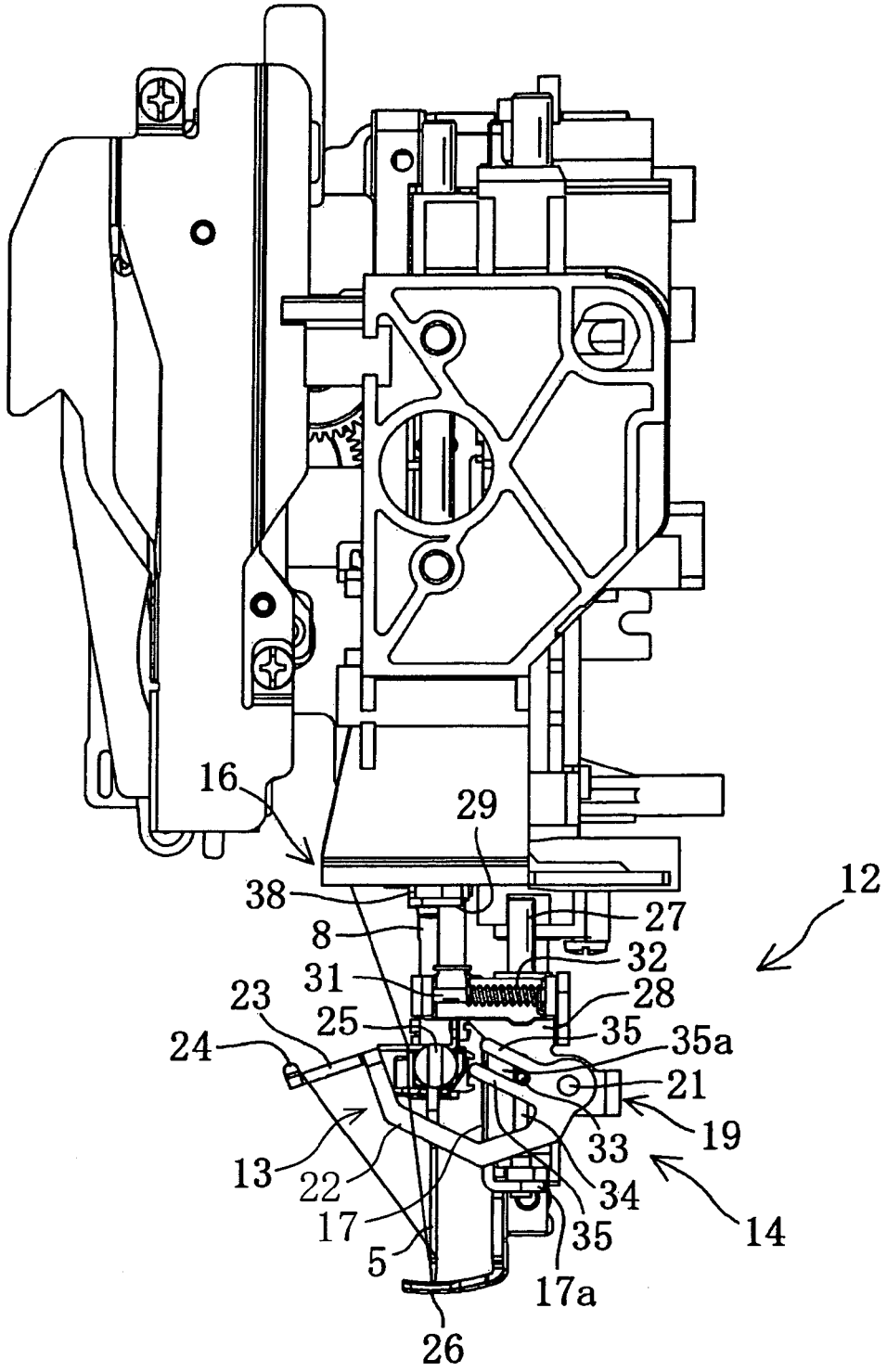
FIG. 8 shows a right side view of the wiper device when the needle bar is swung to the right.
Figure 9:
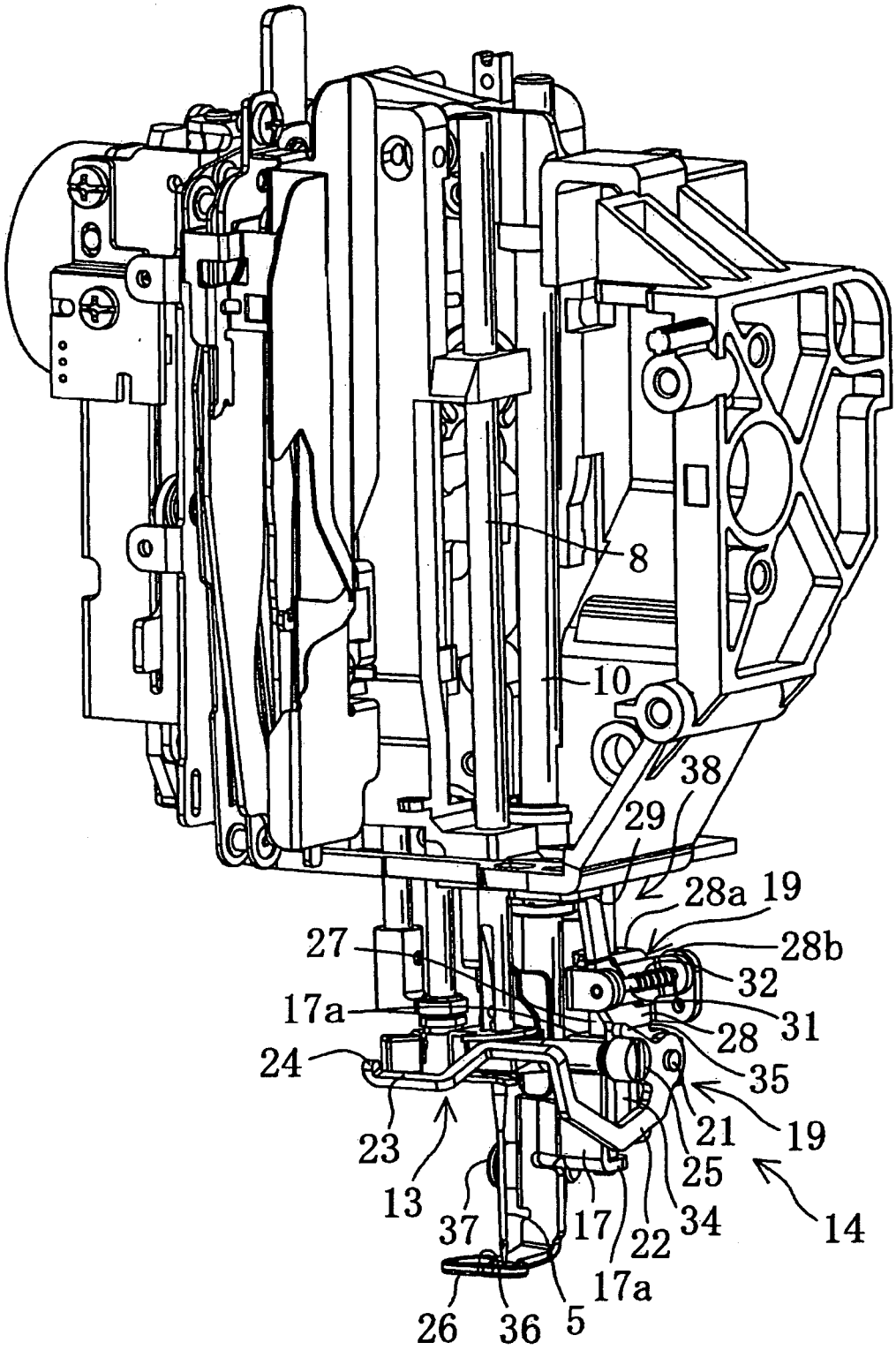
FIG. 9 shows a perspective view of the wiper mechanism when the wiper member is in an operable state.

Next the link mechanism 20 will be described. As shown in FIGS. 4, 5 and 8, the link mechanism 20 includes a drive pin 33 inserted into and fixed to an approximately vertical center of the support shaft 27 in a direction parallel to the thread swinging direction of the needle bar 8. The link mechanism 20 further includes a slit 34 cut out in an vertically elongated form on the main body member 28 of the drive power input member, a pair of link arms 35 provided integrally on the wiper member 13, and a link 35*a* provided on the link arms 35. This drive pin 33 is slidingly engaged with both the slit 34 of the drive power input member 19 and the link 35*a* on the link arms 35.

Next the operation of the link mechanism 20 will be described. When the drive power input member 19 is moved downward with the vertical position of the support member 17 mounted on the presser bar 10 fixed in an immovable state, the position of the horizontal pivotal support axis 21 is fixed on the main body member 28 of the drive power input member 19 is moved downward with respect to the drive pin 33. As a result, the link 35*a* of the wiper member 13 in the disposition to extend diagonally downward towards the front as shown in FIG. 4 moves to the disposition to diagonally extend upward direction toward the front as shown in FIG. 8, as shown in FIG. 4, the thread wiper 23 of the wiper member 13 is moved from the rear of the needle thread extending from the needle eye (eye) to the presser foot 26 in the lower portion to the position in front of the needle fastening member 25 as shown in FIG. 8.

Next, the following describes the wiper drive means 15 to drive the wiper member 13 by the vertical movement of the presser bar 10. The wiper drive means 15 is configured by a vertically moving mechanism to vertically drive the presser bar 10. The presser foot 26 is fixed on the lower end of the presser bar 10 by the fastening screw 37. The support member 17 integrally attached to the presser foot 26 is vertically moved in the up-down direction by the vertical movement of the presser bar 10.

The needle bar platform 38 is in a form to vertically extend nearly in parallel to the needle bar 8 and the upper end is supported by the sewing machine frame (refer to FIG. 11) so as to be capable of swinging. In case this needle bar platform 38 is in a contactable position with the contacting portion 29 of the drive power input member 19, the contacting portion 29 contacts the needle bar platform 38 when the support member 17 is lifted along with the lift of the presser bar 8. On and after the contacting portion 29 contacts the needle bar platform 38, the contacting portion 29 is locked in that position. After that, when the support member 17 is further lifted along with the presser bar 10, as described earlier, the main body member 28 of the drive power input member 19 approaches the support member 17 to resist the elastic member 30 and the position of the horizontal pivotal support axis 21 affixed on the main body member 28 is moved relatively downward against the drive pin 33 of the link mechanism 20. As a result, the wiper member 13 as shown in FIG. 4 is moved from the rear of the needle thread extending to the lower portion of the needle eye of the sewing needle 5 to the front of the needle fastening member 25 as shown in FIG. 8, and wipes the thread as to pull out the needle thread to the needle thread of the work cloth.

By the movement of the wiper member 13 as indicated in FIG. 4, from the rear of the needle thread extending to the lower portion of the presser foot 26 from the needle eye (eye) of the sewing needle 5 of the wiper member 13 to the front side of the needle fastening member 25 as shown in FIG. 8, wipes the thread as to pull out the needle thread residing in the lower surface of the work cloth via the eye to the upper surface of the work cloth.

As shown in FIG. 8, the wiped needle thread extends to the regulator 24 of the wiper member 13 positioned in the front side of the needle fastening-member 25 via the eye.

Figure 10:
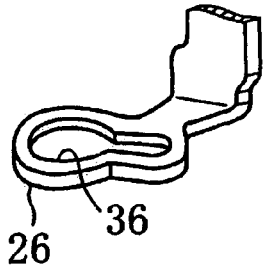
FIG. 10 shows an enlarged view of the main part of the presser foot.

As shown FIG. 10, the ridge 36 of the eye of the presser foot 26, is machined so that the needle thread can smoothly pass through even if the needle thread slides on the ridge 36 of the eye of the presser foot 26.

Next, the switching unit 16 will be described. As shown in FIGS. 2 to 13, the switching unit 16 is configured by the thread swing mechanism 9 and the needle bar platform 38 to support the needle bar 8 so as to be slidable in the vertical direction.

Figure 11:
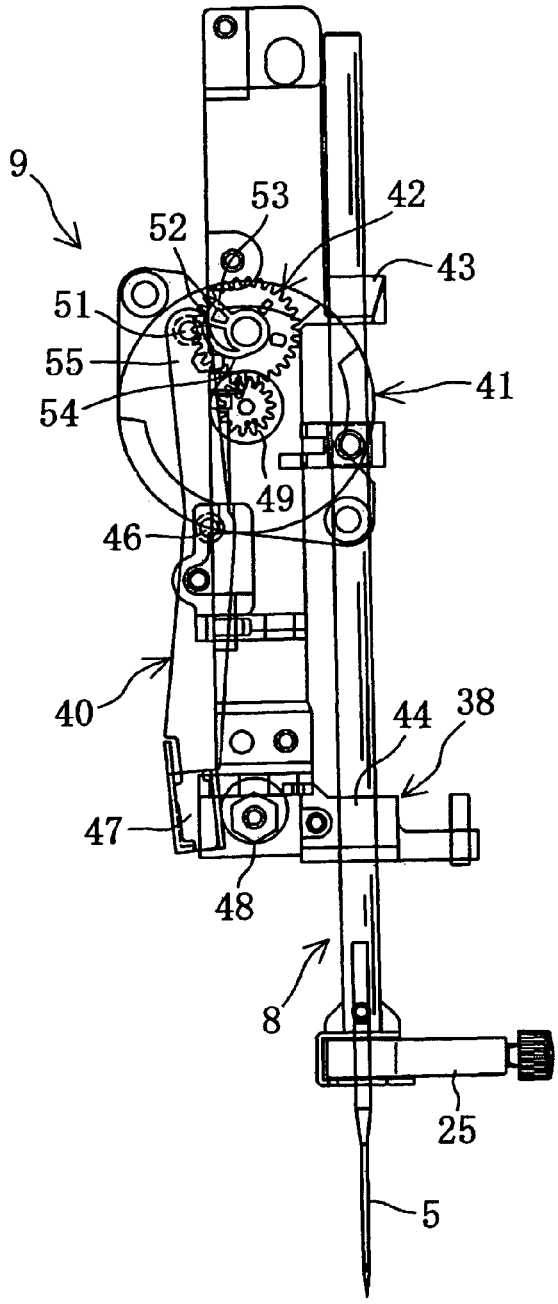
FIG. 11 shows a front view of the needle swing mechanism.
Figure 12:
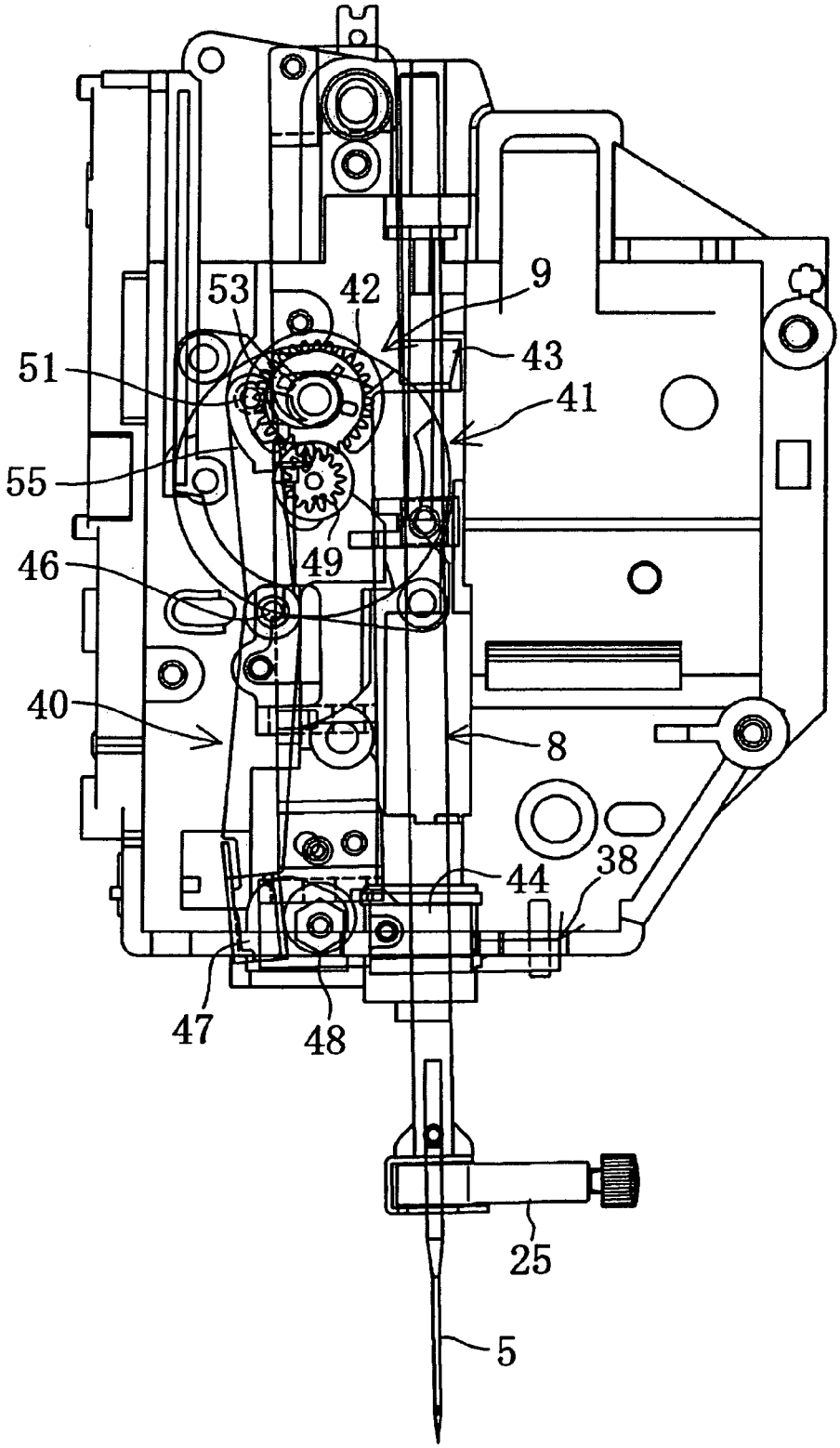
FIG. 12 is a front view of the needle swing mechanism when the needle bar is swung to the right.
Figure 13:
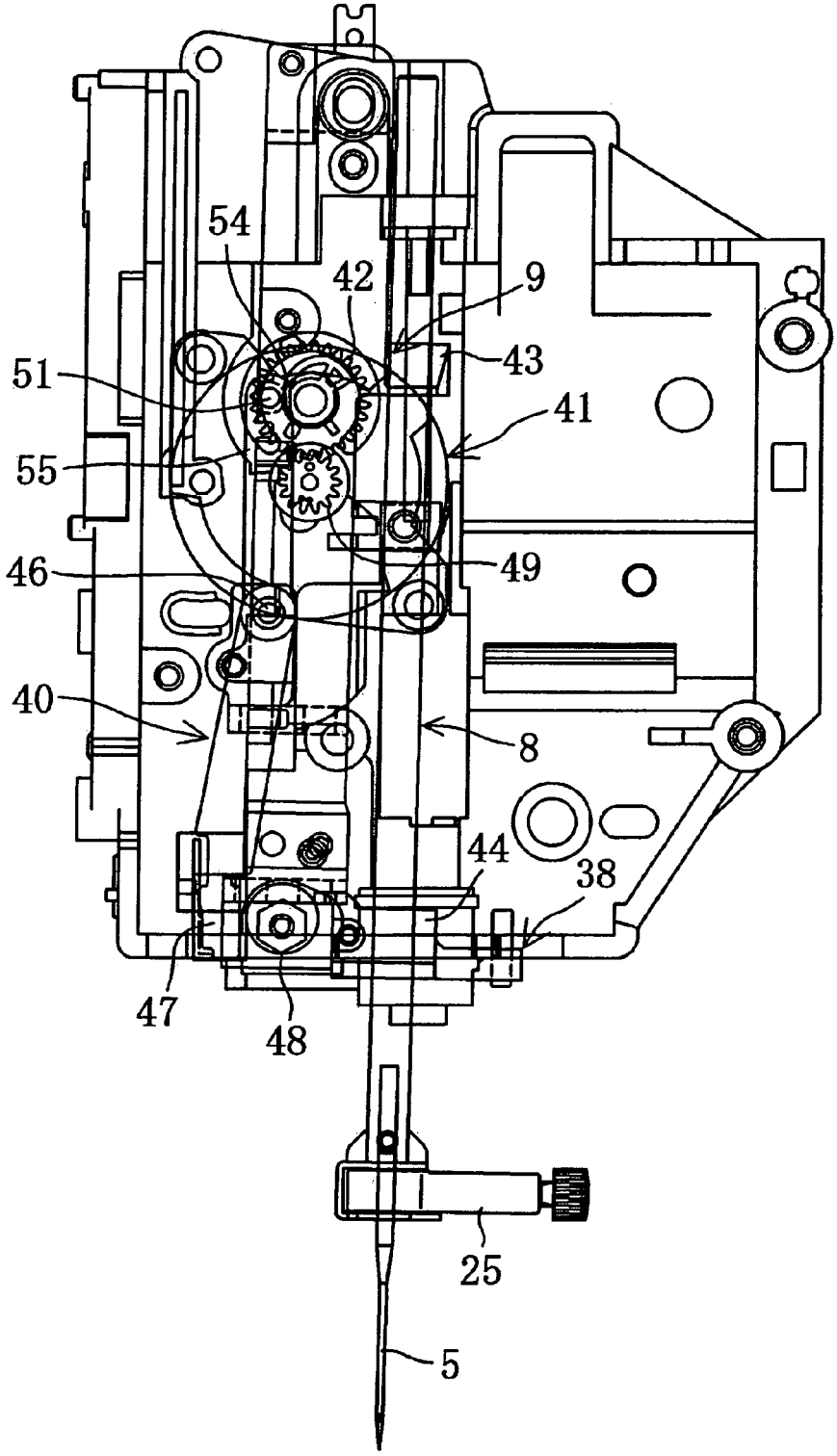
FIG. 13 shows a front view of the needle swing mechanism when the needle bar is swung to the left.

The needle swinging mechanism 9 to swing the needle bar 8 to the prescribed position is described. As shown in FIGS. 11 to 13, the needle swinging mechanism 9 is provided with the needle bar platform 38, swing lever 40, needle swing drive motor 41 and swing cam 42 etc.

As shown in FIG. 11, on the left surface of the needle bar platform 38 having the upper end supported by the sewing machine frame so as to be swingable, an upper side pivotal support 43 and lower side pivotal support 44 are provided, and on these upper side pivotal support 43 and lower side pivotal support 44 the needle bar 8 is vertically moveably supported.

The swing lever 40 is formed to extend in a vertical direction nearly parallel to the needle bar platform 38 and the approximate center of the swing lever 40 in the vertical direction is swingably pivoted by the pivot support pin 46 supported by the sewing machine frame. The lower end 47 of the swing lever 40 is in contact with the cam 48 fixed in the lower end of the needle bar. Also, in the sewing machine frame, the needle swinging drive motor 41 is fixed and on the rotating axis of the needle swinging drive motor, a drive gear 49 is provided. On the outer diameter of the drive gear 49, a gear is formed and a swinging cam 42 supported rotatably on the sewing machine frame is fitted. On this swinging cam 42, a cam surface 52 to laterally swing the needle bar platform 38 is formed and on this cam surface 52, a pin 51 fixed on the upper end 55 of the swinging lever 40 is contacted.

The lower portion of the needle bar platform 38 is biased leftward by the coil spring not shown and the contacting status of the lower end 47 and the cam body 48 and the contacting state of the pin 51 fixed on the upper end 55 and the cam surface 52 is retained. The cam surface 52 formed on the swinging cam 42 is configured by a large radius cam surface 53 spaced apart from the rotational center and a small radius cam surface 54 less distanced from the rotational center and formed consecutively to the large radius cam surface 53 is formed.

As indicated in FIG. 12, when the swinging cam 42 rotates by the rotation of the needle swing drive motor 41 and the pin 51 contacts the large radius cam surface 53 which is spaced apart from the rotational center of the swinging cam 42, the upper end 55 of the swinging lever 40 is moved leftward and the lower portion 47 of the swinging lever 40 is moved rightward via the pivotally supported pin 46 to move the needle bar platform 38 to the right direction.

As shown in FIG. 13, the swinging cam 42 is rotated by the needle swinging motor 41 and when the small cam surface 54 less distanced from the rotational center contacts the pin 51, the upper end 55 of the swinging lever 40 is moved in the left direction and in turn moves the needle bar platform 38 to the left direction.

That is, by the needle swinging mechanism 9, when the lower end 47 of the swinging lever 40 is moved to the right (refer FIG. 12) the needle bar platform 38 is moved by the needle swinging mechanism 9 to a position capable of contacting the contacting portion 29 of the drive power input member 19. In this contactable position, when the support member 17 is lifted along with the presser foot 26 caused by the vertical movement of the presser bar 10, the contacting portion 29 contacts the needle bar platform 38 to actuate the wiper member 13.

On the other hand, when the lower portion 47 of the swinging lever 40 moves leftward (refer to FIG. 13), the needle bar platform 38 is moved to the non-contactable position. In this non-contactable position, even if the support member 17 is lifted along with the presser foot 26 by the vertical movement of the presser bar 10, because the contacting portion is positioned to the right side of the needle bar platform 38 without contacting the needle bar platform 38, the wiper member 13 is not actuated.

Next, the operational effect of the wiper device 12 described above will be described. The wiper device 12 is configured from a wiper mechanism 14 including the wiper member 13 to perform the thread wiper, a wiper driving unit 15 to generate the thread wiping movement of the wiper member by driving the wiper mechanism 14 and a switch unit 16 to switch the wiper member 13 between the operable state and the inoperable state in conjunction with the needle bar 8 with the sewing needle 5 in the lower end. Therefore, after the thread connecting the multiple embroidery areas in the process of embroidery formation is trimmed by the thread trimming unit 59, or after trimming the needle thread after changing the color of the embroidery thread and sew completion, the needle thread can be pulled out to the upper surface of the work cloth by actuating the wiper member 13 by the wiper driving unit 15. Also, by this switching unit 16, the switching of the wiper member 13 state (operable and inoperable) is enabled by using the needle swing mechanism 9 of the needle bar 8.

The wiper device 12 is mounted on the presser bar 10 of the sewing machine main body with a fastening screw 37 therefore the attachment and detachment can be easily performed. Also, because the wiper driving unit 15 is configured by the vertically moving mechanism to vertically move the presser bar 10, a simple, low-cost and small-size configuration can be provided for actuating the wiper member 13.

The wiper device 12 is configured by mounting the support member 17 provided with a presser foot 26 on the presser bar 10, attaching the drive power input member 19 to the support member 17 in a vertically moveable manner, providing an elastic member 30 to bias the drive power input member 19 upward, pivotally supporting the wiper member 13 in a swingable manner to the drive power input member 19 by the horizontal pivotal support axis 21 placed in parallel with the needle swing direction and a link mechanism 20 to convert the relative descending movement of the drive power input member 19 against the support member 17 to the swinging movement of the wiper member 13, therefore, the wiper member 13 can be actuated with a simple mechanism.

The switching unit 16 is arranged so that when the needle bar platform 38 is moved to the right position by the needle swing mechanism 9, the contacting portion of the drive power input member 19 contacts the needle bar platform 38 and when the needle bar platform 38 is in any other position, the contacting portion does not contact the needle bar platform 38 therefore, the wiper member 13 can be reliably switched between the operable state and inoperable state.

The contacting portion 29 of the drive power input member 19 is swingably supported nearly in parallel with the swinging direction of the needle bar platform 38. When the needle bar platform 38 is moved to the right position, which is the operable position of the wiper member 13, from the inoperable state, which is the position other than the right position, after moving the contacting position 29 to a position capable of contacting the needle bar platform 38 by lifting the presser bar 10, the contacting position 29 is pressured by the needle bar platform 38 and moved to the right, so as not to prevent the movement of the needle bar platform 38. Thus the swinging of the needle bar 8 in the prescribed range is not impaired by any limitations.

The wiper member 13 is provided with a circumventing arm 22 so that at the time of performing the thread wipe, the wiper member does not interfere with the needle fastening member 25 provided to fix the sewing needle to the needle bar and provide a smooth operation of the thread wipe.

Next, variations of the above embodiment incorporating partial changes will be described. In the present embodiment, the wiper member 13 which is swingably pivotally supported on the drive power input member 19 by the horizontal pivotal support axis 21 placed in parallel with the needle swinging direction is swung in the longitudinal direction to perform the thread wipe, however, the thread wipe can be performed by pivotally supporting the wiper member 13 to swing in a direction parallel to the needle swinging direction.

The swingable arrangement of the contacting portion 29 of the drive power input member 19 can be arranged so that the contacted portion of the needle bar platform 38 is swung and the contacting portion 29 is fixed.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

What is claimed is:

1. A wiper device for a sewing machine, comprising:

a thread trimmer to trim a needle thread;

a needle bar provided so as to be vertically moveable and having a sewing needle attached on a lower end thereof;

a wiper member to wipe the thread so as to pull out the needle thread extending from an eye of a sewing needle after trimming the needle thread by the thread trimmer to an upper surface of work cloth;

a wiper driving unit to actuate a thread wiping operation of a wiper member; and a switch unit to mechanically switch the wiper member between an operable state and an inoperable state according to a position of the needle bar.

2. The wiper device according to claim 1, further comprising a drive power input member to actuate the thread wiping of the wiper member by being pressed downward by a drive of a wiper driving unit.

3. The wiper device according to claim 2, further comprising a needle bar platform vertically and reciprocably supporting the needle bar and a needle swinging mechanism to swing the needle bar, wherein the drive power input member is provided with a contacting portion contacting the needle bar platform, and the switch unit enables the contacting portion to contact the needle bar platform when in the operable state and to disable the contacting portion to contact the needle bar platform when in the inoperable state by swinging the needle bar to the prescribed position by the needle swinging mechanism.

4. The wiper device according to claim 1, further comprising a vertically moveable presser bar, wherein the wiper driving unit is configured to drive the wiper member by using the vertical movement of the presser bar.

5. The wiper device according to claim 1, further comprising a support member which is mounted on the presser bar and to which the drive power input member is vertically moveably attached; a presser foot attached to the support member; and an elastic member provided on the support member to bias the drive power input member upward, wherein the wiper member is pivotally supported in a swingable manner to the drive power input member by a horizontal pivotal support axis arranged in parallel to a needle swinging direction, and a link mechanism is provided to convert a descent of the input drive power with respect to the support member to a swing of the wiper member.

6. The wiper device according to claim 5, further comprising a needle bar platform vertically and reciprocably supporting the needle bar, wherein the contacting portion of the drive power input member is supported swingably nearly in parallel to the needle swing direction of the needle bar, and in case the needle bar platform is swung to a position corresponding to the operable state after lifting the presser bar to enable the contacting portion to contact the needle bar platform, when the needle bar platform is in a position corresponding to the inoperable state, the contacting portion is swung along with the needle bar platform so as not to prevent the swinging of the needle bar platform.

7. The wiper device according to claim 1, wherein a needle fastening member is provided on the needle bar to fix the sewing needle and the wiper member is provided with a circumventing arm so as not to interfere with the needle fastening member when performing the thread wipe.

8. A wiper device for a sewing machine, comprising:

a thread trimmer to trim a needle thread;

a needle bar provided so as to be vertically moveable and having a sewing needle attached on a lower end;

a presser bar which is provided so as to be vertically moveable and to which a support member having a presser foot in a lower, end thereof is detachably attached;

a wiper member to wipe the thread so as to pull out the needle thread extending from an eye of the sewing needle after trimming the needle thread by the thread trimmer to an upper surface of work cloth;

a wiper driving unit to actuate a thread wiping operation of the wiper member; and a switch unit to mechanically switch the wiper member between the operable state and the inoperable state according to the position of the needle bar.

* * * * *